US009669323B2

(12) United States Patent
Raderman et al.

(10) Patent No.: US 9,669,323 B2
(45) Date of Patent: Jun. 6, 2017

(54) CHILDREN'S TOY

(71) Applicant: KIDS II, INC., Atlanta, GA (US)

(72) Inventors: Elliot Raderman, Groton, MA (US); Milton Aaron Flores, Atlanta, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 14/847,768

(22) Filed: Sep. 8, 2015

(65) Prior Publication Data

US 2016/0067620 A1 Mar. 10, 2016

Related U.S. Application Data

(60) Provisional application No. 62/048,321, filed on Sep. 10, 2014, provisional application No. 62/170,901, filed on Jun. 4, 2015.

(51) Int. Cl.

| | |
|---|---|
| ***A63H 5/00*** | (2006.01) |
| ***A63H 33/22*** | (2006.01) |
| *G10D 13/02* | (2006.01) |

(52) U.S. Cl.

CPC ..... *A63H 5/00* (2013.01); *A63H 33/22* (2013.01); *G10D 13/02* (2013.01)

(58) Field of Classification Search

USPC ..... 446/219, 397, 408, 418; 84/104, 411 R, 84/414, 420, 470 R

See application file for complete search history.

(56) References Cited

U.S. PATENT DOCUMENTS

| | | | | |
|---|---|---|---|---|
| 3,580,126 | A * | 5/1971 | Forkner | A63J 17/00 353/98 |
| 3,978,532 | A | 9/1976 | Scheiner | |
| 4,197,671 | A | 4/1980 | De Brouwer | |
| 6,084,527 | A | 7/2000 | Spector | |
| D477,371 | S * | 7/2003 | Niu | D17/22 |
| 6,716,031 | B2 * | 4/2004 | Wood | A63H 33/00 434/159 |
| 7,163,431 | B2 * | 1/2007 | Walraven | A63H 5/00 446/408 |
| 7,219,456 | B1 | 5/2007 | Wei et al. | |
| 8,029,329 | B2 * | 10/2011 | Greenley | A63H 33/005 446/318 |
| 8,939,811 | B2 * | 1/2015 | Chien | A63H 33/22 434/303 |
| 2004/0266312 | A1 | 12/2004 | Oren et al. | |
| 2008/0120882 | A1 | 5/2008 | Mueller | |
| 2013/0170223 | A1 | 7/2013 | Filoseta et al. | |
| 2014/0273722 | A1 | 9/2014 | Chan et al. | |
| 2015/0072589 | A1 | 3/2015 | Chan et al. | |

* cited by examiner

*Primary Examiner* — Kurt Fernstrom
(74) *Attorney, Agent, or Firm* — Gardner Groff Greenwald & Villanueva, PC

(57) ABSTRACT

A children's toy drum having a drum head that is partially reflective and partially light transmissive. Lights inside of the drum are visible through the drum head when illuminated, and when the lights are not illuminated the drum head acts as a mirror reflecting external light and obscuring visibility of the drum's interior. A second reflector can be positioned toward the base of the drum to generate a light tunnel or other visual effect.

22 Claims, 2 Drawing Sheets

CHILDREN'S TOY

CROSS-REFERENCE TO RELATED APPLICATIONS

This application claims the benefit of U.S. Provisional Patent Application Ser. No. 62/048,321 filed Sep. 10, 2014 and U.S. Provisional Patent Application Ser. No. 62/170,901 filed Jun. 4, 2015, the entireties of which are hereby incorporated herein by reference for all purposes.

TECHNICAL FIELD

The present invention relates generally to the field of children's toys, and more particularly to a toy drum providing visual and sound effects.

BACKGROUND

Simple acoustic children's drum toys generally produce a single tone when struck. Electronic drum toys may produce a variety of sound effects when struck, by way of an electronic transducer or speaker component and actuator. However, traditional acoustic and electronic drums typically do not provide significant visual effects or stimulation for users.

It is to the provision of an improved children's drum toy providing both visual and sound effects that the present invention is primarily directed.

SUMMARY

In example embodiments, the present invention provides an improved children's drum toy providing both visual and sound effects. The sound effects may be generated acoustically and/or electronically. The visual effects are optionally generated by one or more light sources within the drum housing, and enhanced by reflection.

In one aspect, the present invention relates to a children's toy drum including a drum head having a first reflective element, a second reflective element spaced a distance from the first reflective element, and at least one light source positioned between the first reflective element and the second reflective element.

In another aspect, the invention relates to a drum including a hollow drum shell, a drum head mounted to a first end of the drum shell, and including a partially reflective material, and at least one light source within the drum shell. The at least one light source is visible through the partially reflective material of the drum head from external of the drum when the at least one light source is illuminated, and the partially reflective material of the drum head reflects light from external of the drum when the at least one light source is not illuminated.

In still another aspect, the invention relates to a children's toy including a partially reflective and partially light transmissive two-way mirror material, a second reflective element spaced a distance from the partially reflective and partially light transmissive two-way mirror material, and at least one light source positioned between the partially reflective and partially light transmissive two-way mirror material and the second reflective element. The at least one light source is visible through the partially reflective and partially light transmissive two-way mirror material from external of the toy when the at least one light source is illuminated, and the partially reflective and partially light transmissive two-way mirror material of the toy reflects light from external of the toy when the at least one light source is not illuminated.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
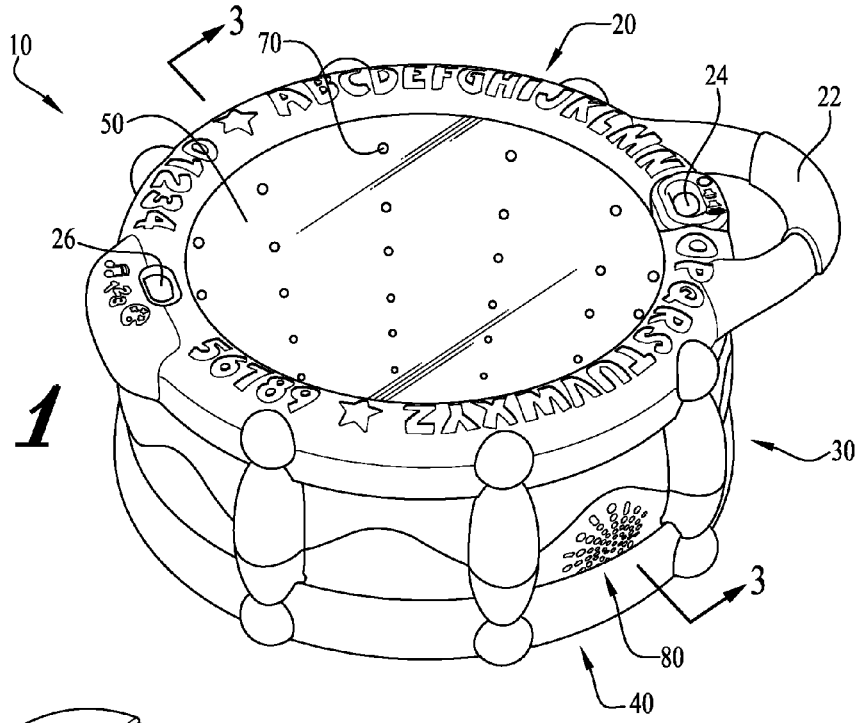
FIG. 1 is a perspective view of a children's drum toy according to an example embodiment of the present invention.
Figure 2:
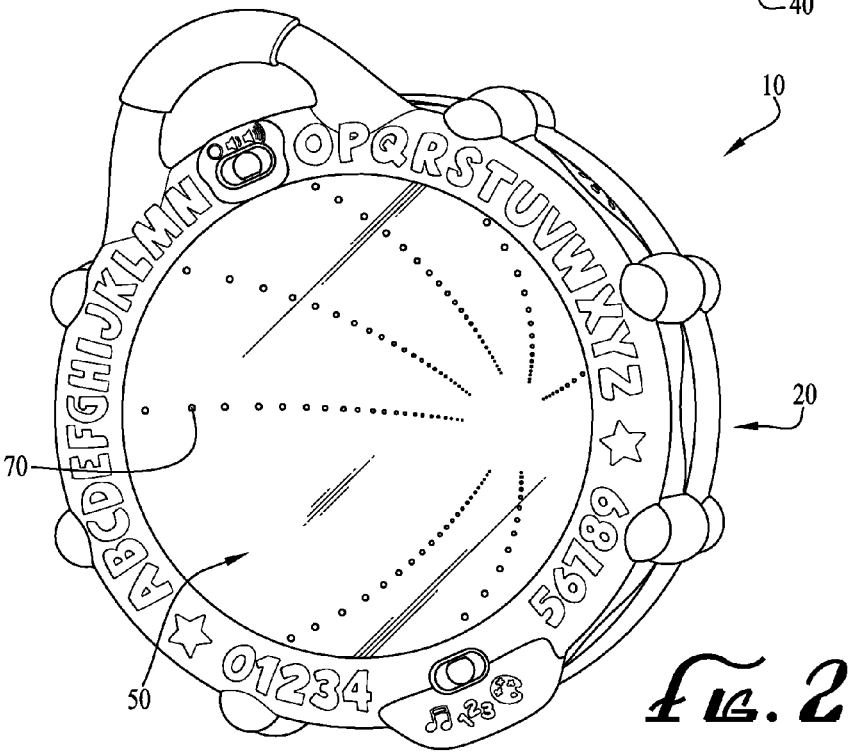
FIG. 2 is a top view of the children's drum toy of FIG. 1.
Figure 3:
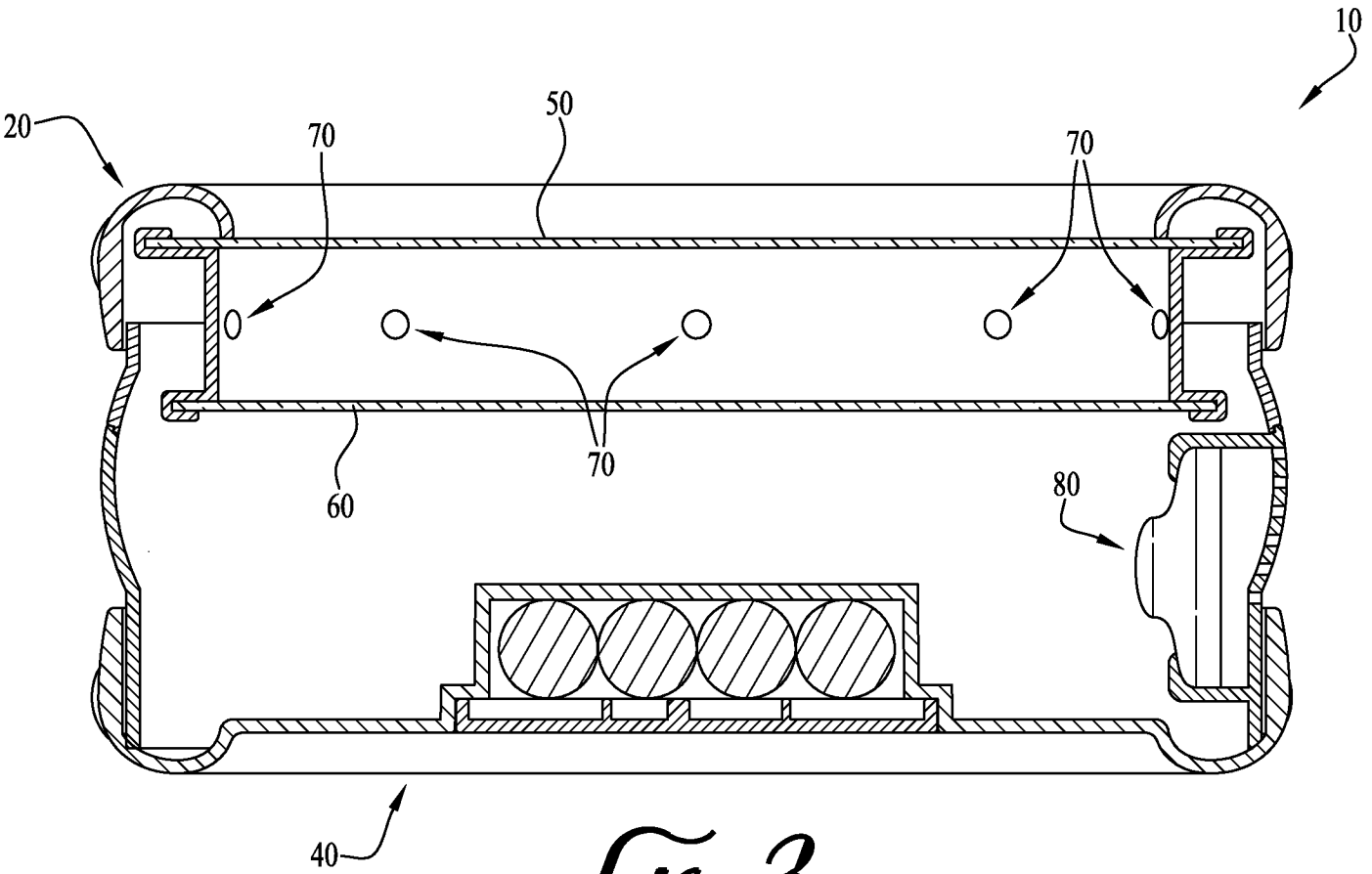
FIG. 3 is a cross-sectional view of the children's drum toy of FIG. 1.

With reference now to the drawing figures, wherein like reference numbers represent corresponding parts throughout the several views, FIGS. 1-3 depict a toy drum 10 according to an example embodiment. The drum 10 generally comprises a top drum head hoop component 20, a support body or shell 30, and a bottom head or base 40. In example embodiments, the top drum head hoop component 20, support body or shell 30 and bottom head or base 40 are fabricated from hard plastic or other substantially rigid materials of construction, and may be integrally formed or formed separately and assembled together. The components are optionally multi-colored for improved visual appeal.

The top drum head hoop component 20 comprises a ring defining a central opening in which a top drum head 50 is mounted. The top drum head 50 is preferably a thin panel or sheet of impact-resistant material to withstand a user drumming or striking thereon with hands or drum sticks. In example form, the top drum head 50 is a partially transparent or translucent and partially reflective element, for example a two-way mirror, or an optical isolator. The top surface of the top drum head 50 visible from the drum's exterior is preferably reflective, and the bottom surface of the top drum head 50 on the drum's interior is preferably light-transmissive.

A bottom mirror component 60 is optionally mounted within the support body or shell 30 above or on the bottom head or base 40 and spaced a distance below the top drum head 50. The bottom mirror component 60 preferably comprises a reflective one-way mirror upper surface facing toward the top drum head 50. The bottom mirror component 60 is preferably oriented in a generally parallel plane with the top drum head 50. In example embodiments, the reflective and/or partially reflective components of the top drum head 50 and bottom mirror component 60 comprise a metalized polyester such as Mylar or other reflective material.

One or more light sources 70 such as light emitting diode (LED) lights or light strings or small incandescent bulbs are preferably mounted to the interior of the drum within the support body or shell 30 between the top drum head 50 and the bottom mirror component 60. The light sources 70 are optionally multi-colored for improved visual appeal. The light sources may be mounted on or along the support body or shell 30 at one or more locations spaced about the circumference thereof, and/or on the bottom mirror 60, and/or on the top mirror 50. In example embodiments, the LED light strings extend from a first end positioned at or adjacent the top drum head 50 to a second end positioned at or adjacent the bottom mirror component 60. The light strings may extend parallel with the central axis of the drum 10 in a generally linear and axial array, or alternatively in a spiral or helical array. In alternate embodiments, the light strings are arranged in one or more circumferential rings spaced axially along the height of the drum 10 between the top drum head 50 and the bottom mirror component 60.

The top drum head hoop component 20 optionally includes a carrying handle 22, a power switch 24, and a selector switch or actuator 26. Letters, numbers, ornamentation, branding indicia, or other items may optionally be applied onto or formed into the top drum head hoop component 20, the support body or shell 30, and/or other surfaces of the drum toy 10. The support body or shell 30 can be, for example, a cylindrical perimeter wall or walls continuously connecting the top mirror 50 to the base 40 and/or bottom mirror 60, or can be one or more posts or connecting panels extending therebetween. Optionally a speaker or sound and/or vibration transducer 80 is mounted to or within the support body or shell 30. An internal power source such as one or more DC batteries, and/or a cord for connection to an external power source such as an AC outlet are optionally provided to power the lights 70 and/or sound effects 80.

The switch 24, selector 26 and/or onboard electronic controls are optionally configured to activate the light source(s) 70 when the drum 100 is struck, via a jiggle switch or motion sensor, or by other activation method. One or more of the light sources 70 can be configured to activate separately or sequentially from other of the light sources 70, so as to create an interesting visual image or motion effect. The light source(s) 70, when activated and illuminated, can illuminate the interior of the drum 10 and be visible from the drum's exterior through the top two-way mirror drum head component 50. The bottom mirror 60 can reflect light from the light source(s) 70 and/or the two-way mirror of the top drum head 50, creating a unique visual image such as a light tunnel visible within the drum 10 from the exterior of the drum 10, as shown in FIG. 2. When the light source(s) 70 are not activated, the top drum head 50 presents a reflective surface that can function as a regular mirror, reflecting images from the drum's exterior and obscuring visibility into the drum's interior. Optionally, the interior of the drum includes patterns, designs or other indicia that may be light reflective or fluorescent, which are illuminated and visible through the drum head when the light sources are on, but not visible when the light sources are off.

The drum 10 can include various other features such as music, sounds, vibration, etc., and these features can be triggered by striking a surface of the drum. The sound effects can be synchronized or otherwise coordinated with the light effects generated by the light sources 70, for example causing the lights to flash in time with the beat of the drum. In other embodiments, the toy can take the form of an instrument other than a drum, and/or can be configured in any other shape. In still other embodiments, the drum is an actual instrumental drum, rather than a toy drum.

While the invention has been described with reference to preferred and example embodiments, it will be understood by those skilled in the art that a variety of modifications, additions and deletions are within the scope of the invention, as defined by the following claims.

What is claimed is:

1. A children's toy drum comprising:

a drum head comprising a first reflective element, wherein the first reflective element comprises a partially reflective and partially light transmissive two-way mirror material;

a second reflective element spaced a distance from the first reflective element; and at least one light source positioned between the first reflective element and the second reflective element.

2. The children's toy drum of claim 1, wherein the second reflective element is a one-way mirror.

3. The children's toy drum of claim 1, wherein the at least one light source is an LED light source.

4. The children's toy drum of claim 3, wherein the LED light source is a light string comprising a plurality of LED lights.

5. The children's toy drum of claim 4, comprising a plurality of LED light strings.

6. The children's toy drum of claim 1, further comprising a speaker for generating sound effects.

7. The children's toy drum of claim 6, wherein the sound effects are coordinated with light effects generated by the at least one light source.

8. The children's toy drum of claim 1, further comprising a drum shell to which the drum head is mounted, and defining an internal chamber containing the second reflective element and the at least one light source.

9. A drum comprising:

a hollow drum shell;

a drum head mounted to a first end of the drum shell, and comprising a partially reflective material; and at least one light source within the drum shell;

whereby the at least one light source is visible through the partially reflective material of the drum head from external of the drum when the at least one light source is illuminated, and whereby the partially reflective material of the drum head reflects light from external of the drum when the at least one light source is not illuminated.

10. The drum of claim 9, further comprising a second reflective material within the drum shell and spaced a distance from the partially reflective material of the drum head, whereby the at least one light source is positioned between the partially reflective material of the drum head and the second reflective material.

11. The drum of claim 9, wherein the at least one light source is an LED light source.

12. The drum of claim 11, wherein the LED light source is a light string comprising a plurality of LED lights.

13. The drum of claim 12, comprising a plurality of LED light strings.

14. The drum of claim 9, further comprising a speaker for generating sound effects.

15. The drum of claim 14, wherein the sound effects are coordinated with light effects generated by the at least one light source.

16. A children's toy comprising:

a partially reflective and partially light transmissive two-way mirror material;

a second reflective element spaced a distance from the partially reflective and partially light transmissive two-way mirror material; and at least one light source positioned between the partially reflective and partially light transmissive two-way mirror material and the second reflective element;

whereby the at least one light source is visible through the partially reflective and partially light transmissive two-way mirror material from external of the toy when the at least one light source is illuminated, and whereby the partially reflective and partially light transmissive two-way mirror material of the toy reflects light from external of the toy when the at least one light source is not illuminated.

17. The children's toy of claim 16, wherein the toy is a toy drum, and the partially reflective and partially light transmissive two-way mirror material comprises at least a portion of a drum head of the toy drum.

18. The children's toy of claim 16, wherein the at least one light source is an LED light source.

19. The children's toy of claim 18, wherein the LED light source is a light string comprising a plurality of LED lights.

20. The children's toy of claim 19, comprising a plurality of LED light strings.

21. The children's toy of claim 16, further comprising a speaker for generating sound effects.

22. The children's toy of claim 21, wherein the sound effects are coordinated with light effects generated by the at least one light source.

* * * * *